US005505598A

United States Patent [19]

Murray

[11] Patent Number: 5,505,598

[45] Date of Patent: Apr. 9, 1996

[54] MILLING MACHINE WITH MULTI-WIDTH CUTTER

[75] Inventor: Stuart W. Murray, Brentwood, Tenn.

[73] Assignee: Wirtgen America, Inc., Nashville, Tenn.

[21] Appl. No.: 282,329

[22] Filed: Jul. 29, 1994

[51] Int. Cl.[6] ..... E01C 23/12

[52] U.S. Cl. ..... 404/90

[58] Field of Search ..... 404/90, 91; 299/80, 299/36

[56] References Cited

U.S. PATENT DOCUMENTS

| | | | |
|---|---|---|---|
| 4,489,985 | 12/1984 | Kendrick | 299/80 |
| 4,720,207 | 1/1988 | Salani | 404/90 |
| 5,083,839 | 1/1992 | Younger | 404/90 X |

OTHER PUBLICATIONS

CMI Corporation, Variable-Width Cutters, Feb. 94.

*Primary Examiner*—William P. Neuder
*Attorney, Agent, or Firm*—Waddey & Patterson; I. C. Waddey, Jr.

[57] ABSTRACT

A modification of a cold milling machine used to remove concrete and asphalt from an existing highway is disclosed, including a milling drum segmented into two or more sections with the drive train for the milling drums passing through the core of the milling drum and supported via a journal or bearing to the outside of the machine. One or more sections of a milling drum may be added to the drum to vary its length. The sections of the milling drum can be added by bolting segments of the drum onto a driven sleeve which telescopes over the drive shaft of the machine. The segments of the milling drum can be readily removed by loosening a few bolts and removing the segments without having to slide a milling drum segment off of either end of a drive shaft. A segmented moldboard is also disclosed which allows the moldboard to be adjusted in segments, depending upon the cutting width of the milling drum of the machine. The segmented moldboards can be bolted together and are hydraulically operated between an operating position and a docking position. The hydraulic structure of the moldboards also allows the segments of the moldboard to float on the surface of the road or highway at a height depending upon whether or not the moldboard is following a portion of the highway that has been cut or a portion of the highway that is undisturbed.

31 Claims, 14 Drawing Sheets

MILLING MACHINE WITH MULTI-WIDTH CUTTER

BACKGROUND OF THE INVENTION

The present invention relates generally to milling machines and more particularly to milling machines for asphalt, concrete, and other road surface materials so that a worn surface may be removed and replaced with new material. Milling machines of this type have, in the past, had fixed width cutters. My invention is an improvement of the known machines by providing a cutter that can be readily and easily converted from one width to another and particularly, to provide for a cutting width of 2', 3' or 4' (or any other selected increments between 24" and 52") with minimal down time in the operation of the machine and with minimal man power required to make the conversion. Further, my invention is designed to enable each cut to be made at the optimal outside location of the machine so that the machine can make different width cuts directly adjacent bridge abutments, embankments, and severe slopes (such cuts being generally referred to in the industry as "flush cuts" and the practice as "flush cutting").

It will be appreciated by those skilled in the art that highways, parkways, roads and streets that serve as thoroughfares for motor vehicle travel in this country are subject to tremendous wear and tear and eventual decay. Also, there are often occasions when roads and highways must be improved by widening them or adding lanes in order to accommodate increased motor vehicular traffic. Such roads and highways are generally paved with concrete or asphalt. In order to repair them, it is usually necessary to remove the concrete or asphalt, or to remove at least a portion of the concrete and asphalt, requiring a cut of several inches of depth.

When existing roads are be repaired, it is necessary to remove the material of the portion of the road or highway passing beneath overpasses so that when new material is paved over the existing surface, the height of the road will not be increased and thereby reduce the clearance between the road and the underpass. Such clearances are generally specified to reasonably close tolerances and if the repair of the road increases the height of the road by adding new material to it, after several repairs, the clearance between the road and the underpass will be reduced to a point that certain traffic, particularly tractor trailer rigs and the like would crash into the lower side of the overpass if the material of the road was not removed prior to repaving. Likewise, on bridges and overpasses, when roads are repaired, it is necessary to remove the existing material before applying a new surface in order to reduce the weight on the bridge or overpass, such bridges and overpasses normally having been engineered to accommodate a specified weight limit. Continually adding new weight by adding the weight of resurfacing material may exceed the limitations of such bridges and overpasses when the weight of vehicles traveling over those bridges and overpasses is added to the equation.

Finally, in the repair of the existing roads and highways, there are numerous bridge abutment, guard rail and other traffic control barriers along the roads. It is important to be able to remove the asphalt or concrete as closely adjacent such barriers as possible through automatic equipment and milling machines of the type to which this invention is directed so as to eliminate manual labor in removing the material directly adjacent such barriers. Similarly, it is important to be able to use milling machines to remove material adjacent embankments and slopes without having to use manual labor for that job.

In the improvement of existing highways and roads, particularly when highways and roads are being widened, cuts have to be made in the existing shoulder of the old road in order to provide for a base of rock and other compressed material and a layer of asphalt or concrete over the base material. The finished job must have the widened portion of the highway be at the same level as the refinished existing highway. These cuts often have to be made in cities adjacent sidewalks, over existing roads adjacent bridges and other areas where embankments, slopes, and highway appurtenances require that the machine cut at its extreme most outside edge because there is no room for the tracks of the machine beyond the cutting point. It is appropriate to note at this point of discussion of the background of the invention that in machines of this type, the power train for driving the cutter is generally positioned on what is referred to as the "inside" of the machine because if it were located on the "outside" of the machine, it would extend beyond the cutting edge and limit the ability of the machine to make flush cuts. Further, practical aspect of the design of machines of this nature require that the drive train provide power to the cutter via an axil passing through the cutter itself and drive the cutter from the inside of the machine.

In machines currently available in the marketplace, such as machines available through Applicant's assignee, Wirtgen America, Inc., Nashville, Tenn., for the milling machine to make cuts of varying width, the entire cutter has to be removed and replaced with a different sized cutter. Such devices include the Wirtgen 1900 DC cold milling machine which is readily available on the marketplace and which is illustrated and described in the sales brochure identified in the bibliography attached hereto and a copy of which is supplied with this application and incorporated herein by reference.

Cold milling machines are the type that my invention is designed to modify fall in the category of road building or material handling equipment. The machines themselves may cost as much as $750,000 and the cost of a milling drum with cutter elements can be as much as $200,000. Thus, while there have been provided machines that allow different cutting widths by interchanging the milling drums, such devices require that the operator have on hand two or more milling drums and if the operator is required to purchase several milling drums, the cost of each additional drum is significant. Further, in existing equipment, conversion from one width to another by exchanging one milling drum for another requires several men because of the size and weight of the equipment and may take as much as two full days to accomplish. One days down time for a machine of this type is a significant economic loss to the contractor because it slows the completion of the job and requires the use of expensive man power.

What is needed then is a method of conveniently and quickly changing the width of cut of a milling drum in a cold milling machine designed for making cuts of a depth up to 12" in highway concrete, asphalt and rock base and in widths varying from 2' to 4'. Such a device is presently lacking in the prior art and in the marketplace.

It is therefore an object of the present invention to provide a new and improved cold milling machine that can be readily converted from one cutting width to another with use of minimum man power and time.

It is another object of the present invention to provide such an improved cold milling machine that will allow cuts of up to 12" deep substantially in line with the outside of the machine.

It is a further object of the present invention to provide an improved machine with a moldboard or scraper that can be varied in width to accommodate varying widths of the cutter and can be varied in height along its width to accommodate the depth of cut being performed by the machine.

It is yet another object of the present invention to provide such an improved cutter where the change in the width of the cutter can be accomplished by a single workman using simple hand tools and accomplished within 2–3 hours.

Having described generally the objects of the present invention, Applicant's invention will be better understood when considered in light of the accompanying drawings and the following description of the preferred embodiment.

SUMMARY OF THE INVENTION

A modification of a cold milling machine used to remove concrete and asphalt from an existing highway is disclosed, including a milling drum segmented into two or more sections with the drive train for the milling drums passing through the core of the milling drum and supported via a journal or bearing to the outside of the machine. One or more sections of a milling drum may be added to the drum to vary its length. The sections of the milling drum can be added by bolting segments of the drum onto a driven sleeve which telescopes over the drive shaft of the machine. The segments of the milling drum can be readily removed by loosening a few bolts and removing the segments without having to slide a milling drum segment off of either end of a drive shaft. A segmented moldboard is also disclosed which allows the moldboard to be adjusted in segments, depending upon the cutting width of the milling drum of the machine. The segmented moldboards can be bolted together and are hydraulically operated between an operating position and a docking position. The hydraulic structure of the moldboards also allows the segments of the moldboard to float on the surface of the road or highway at a height depending upon whether or not the moldboard is following a portion of the highway that has been cut or a portion of the highway that is undisturbed.

DESCRIPTION OF THE PREFERRED EMBODIMENT

Figure 8:
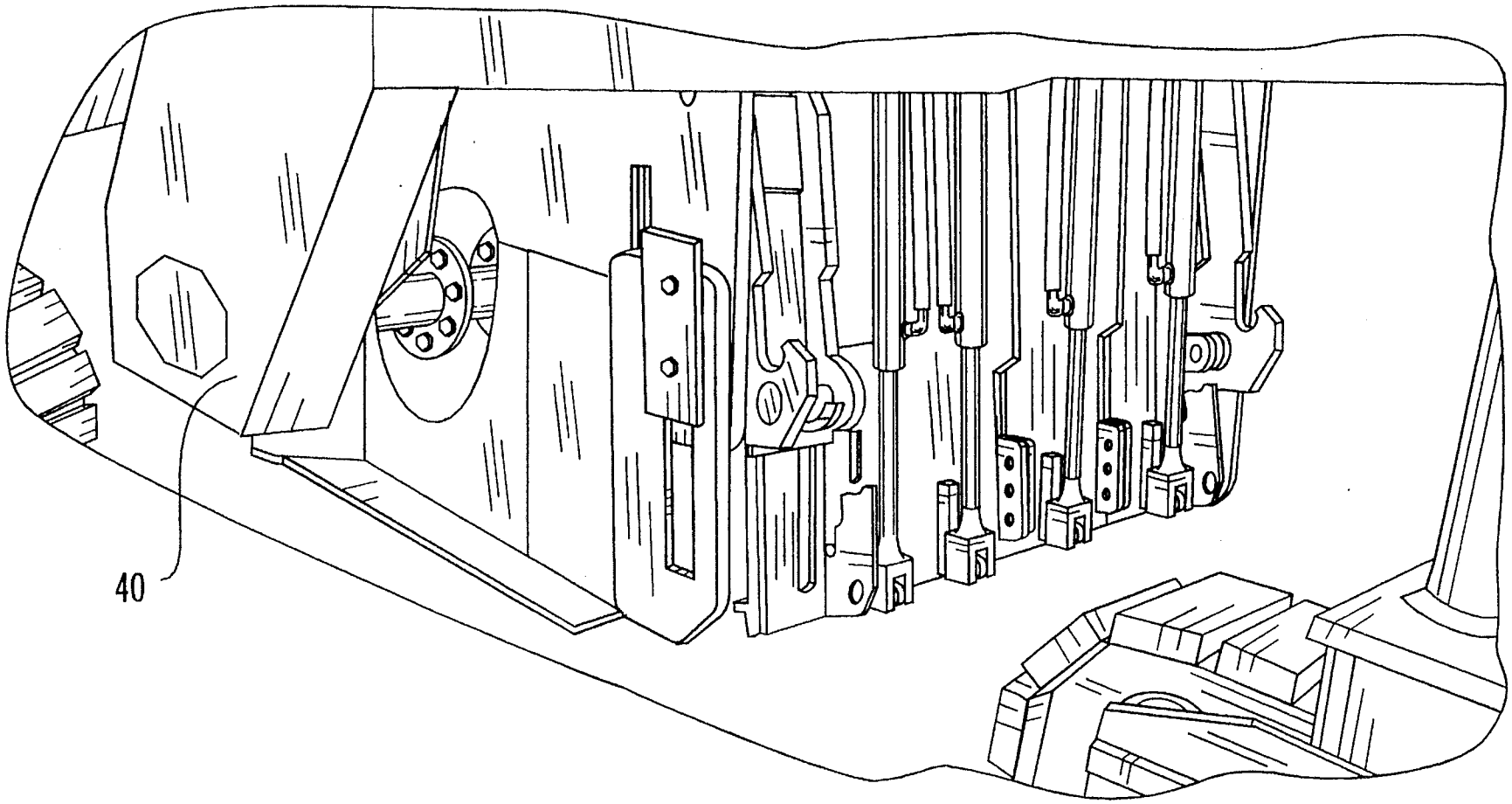
FIG. 8 is a photographic illustration of the device of the present invention from the drive side of the machine showing the drive train for the cutter the moldboard set for 4' configuration.
Figure 14:
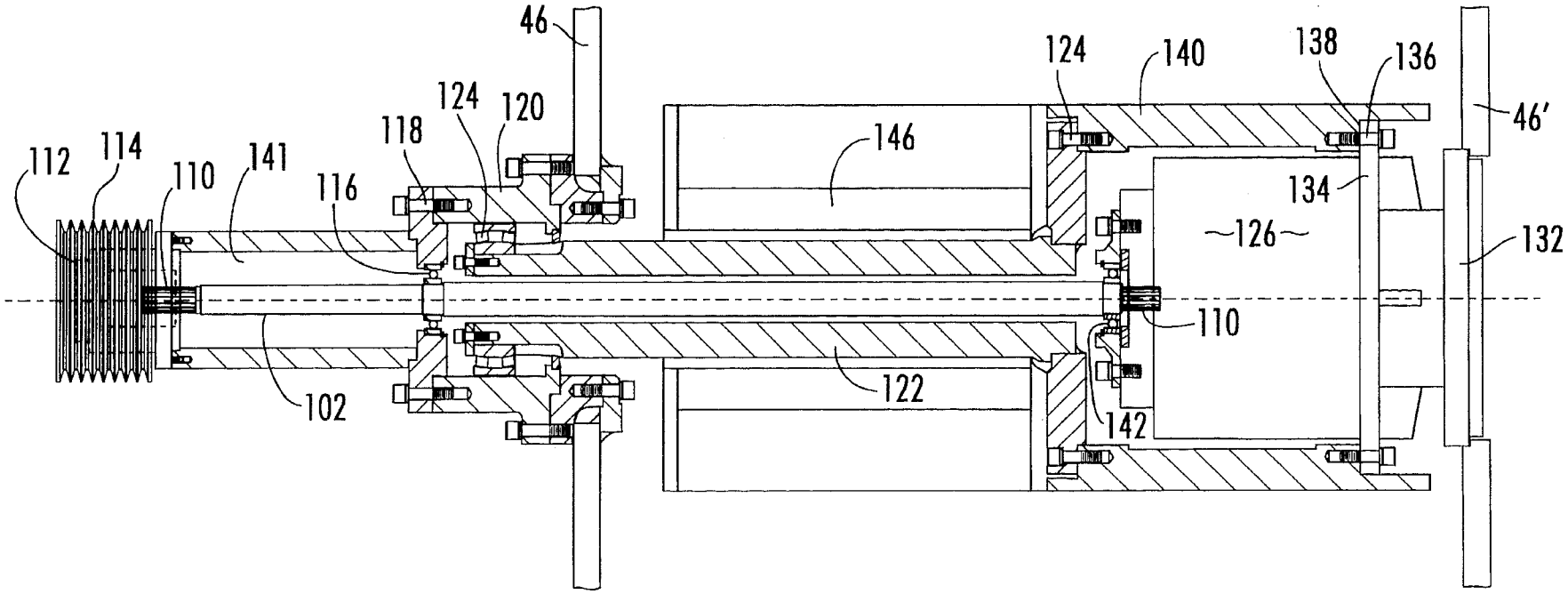
FIG. 14 shows a section of the drive train for powering the milling drum of the present invention.

The preferred embodiment of the invention will be best understood when considered in conjunction with the attached drawings. In the description of the preferred embodiment, the cold milling machine will be described in conjunction with the drawings as they are oriented. Thus, the front of the cold milling machine will generally be to the fight and the rear to the left in Figures such as 1, 2 and 3. Similarly, FIGS. 6–7 and 9–12 are views from the fight rear of the machine. FIG. 8 is viewed from the left rear of the machine and FIGS. 4, 5, and 14 are viewed from the rear of the machine.

Figure 1:
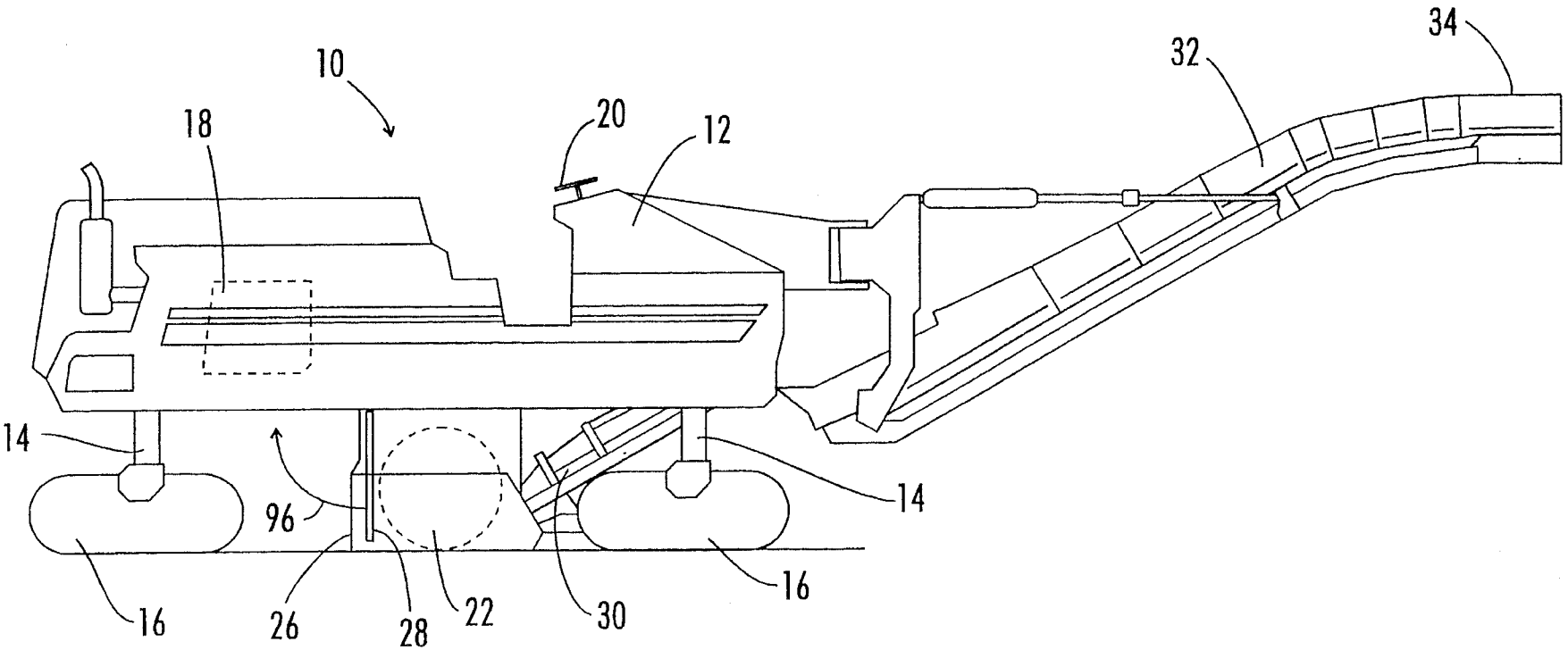
FIG. 1 is a schematic illustration of a side view of a machine of the type which Applicant's invention is designed to modify.
Figure 5:
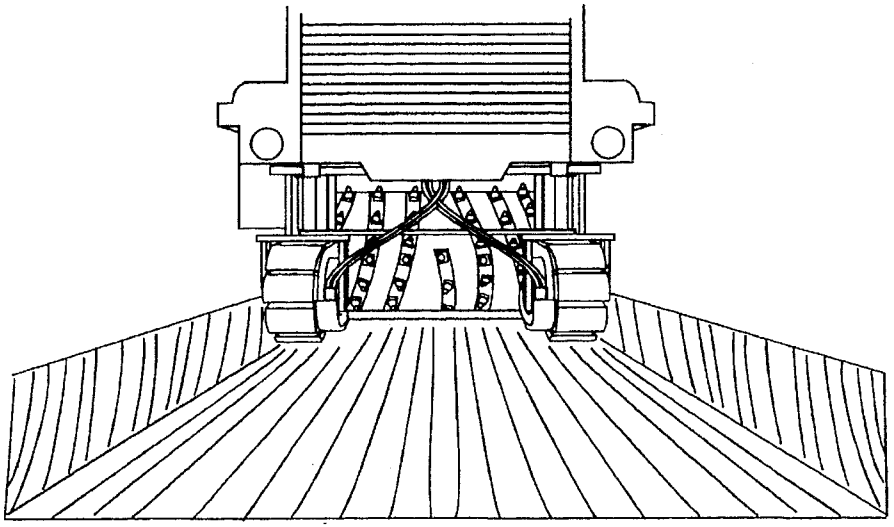
FIG. 5 shows a rear view of the present invention in a 6' configuration.
Figure 4:
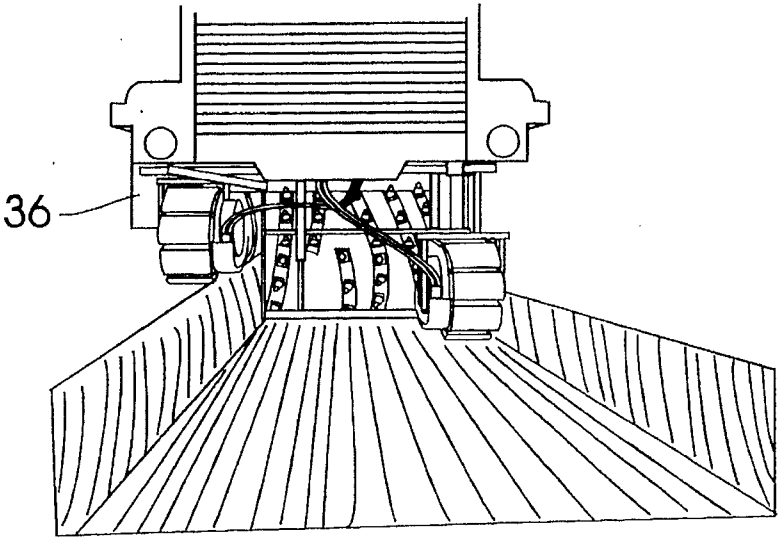
FIG. 4 shows a rear view of the improvement of the present invention with the cutter in 4' configuration.
Figure 6:
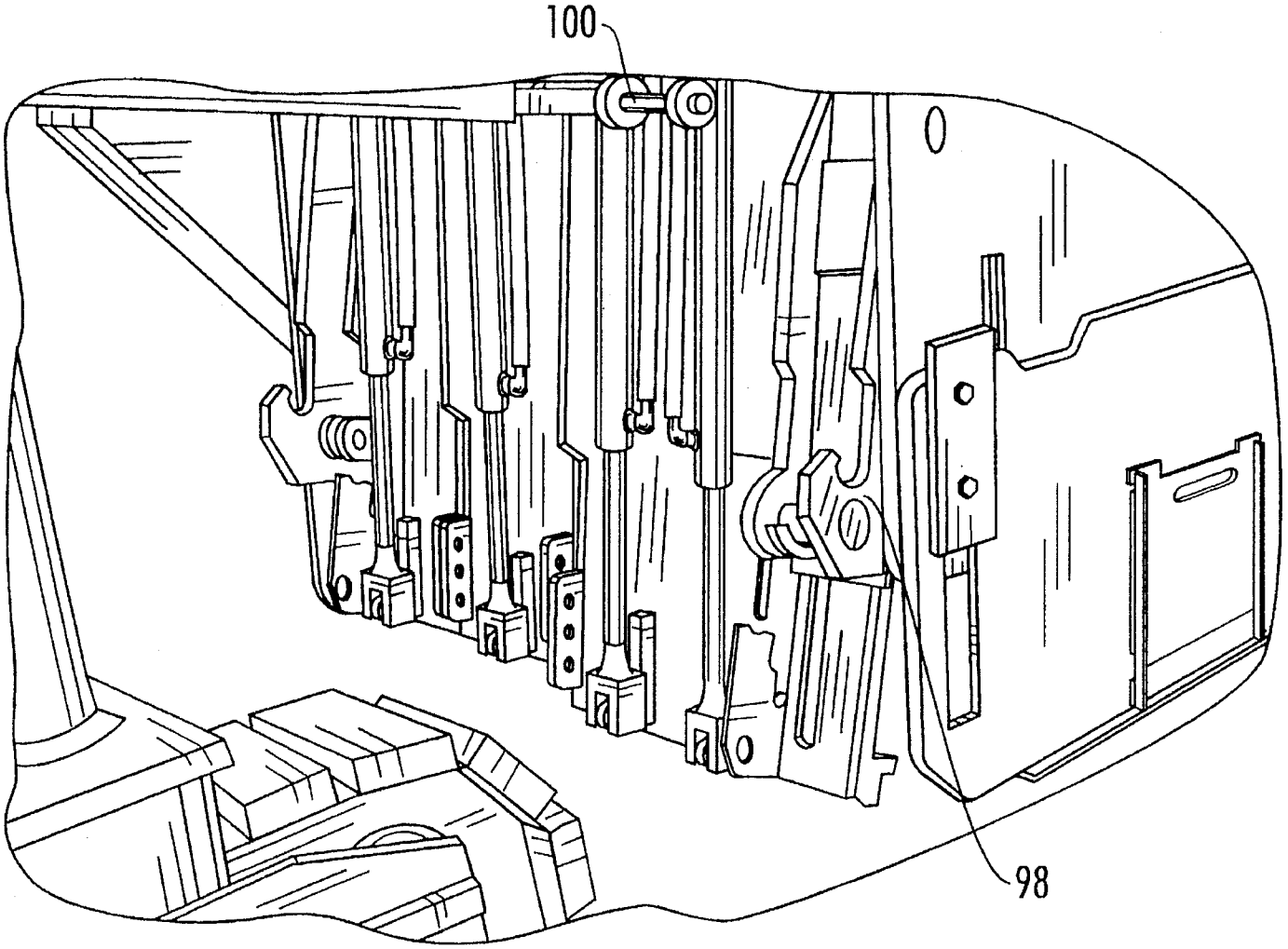
FIG. 6 is a photographic illustration of the device of the present invention with the height of the moldboard adjusted and the cutter in 2' width configuration.
Figure 7:
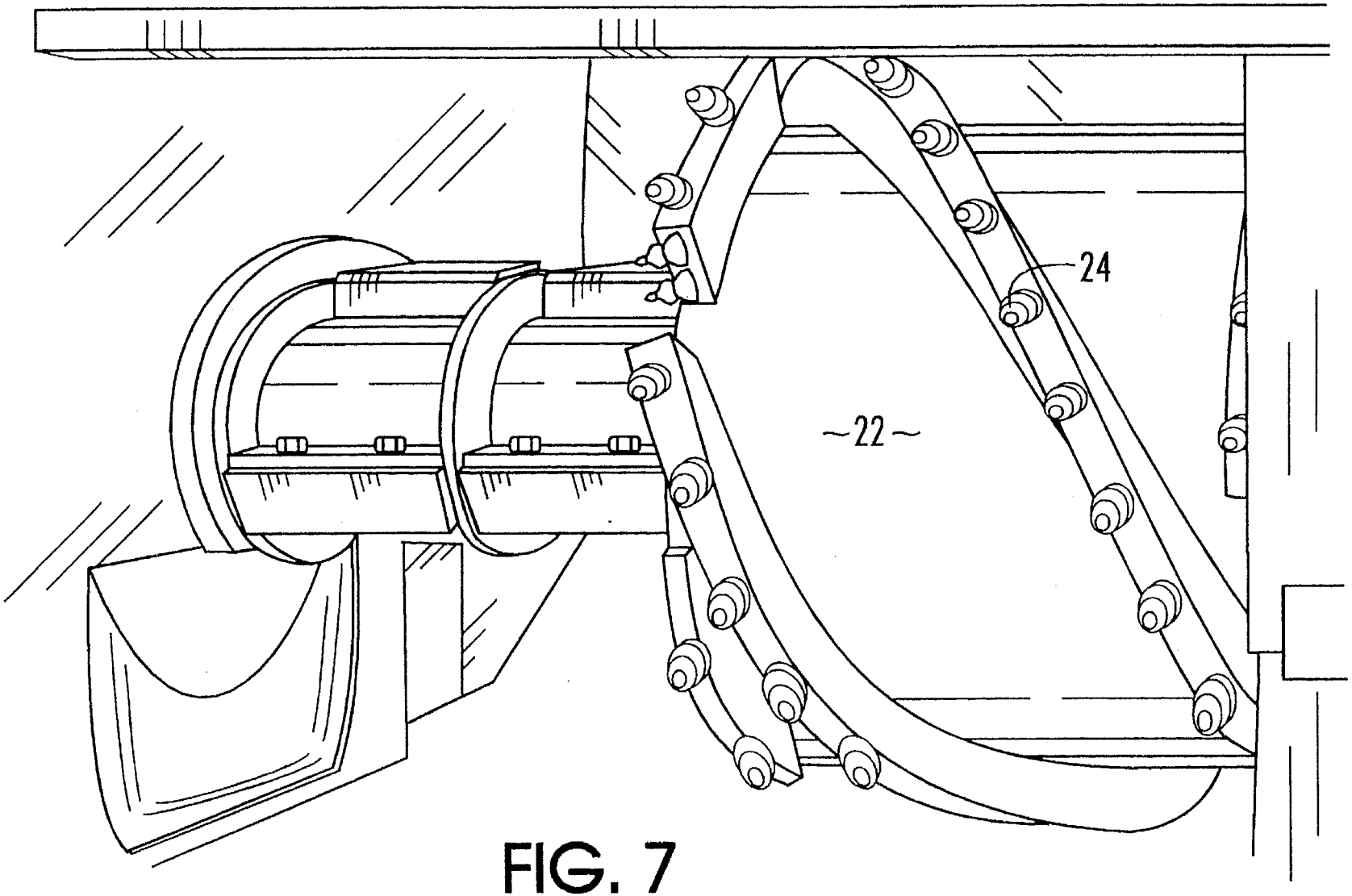
FIG. 7 shows a photographic illustration of the improvement of the present invention from the flush cut side of the machine with the moldboard raised in a docking position and the milling drum in a 2' configuration.

In operation, the machine moves from left to right when viewed from the direction shown in FIG. 1 and the flush cut side of the machine is to the right as seen in FIGS. 4 and 5 and the cutter drive of the machine is to the left as is seen from FIGS. 4 and 5.

Before describing Applicant's invention itself, a brief description of a cold milling machine of the type for which Applicant's invention is designed will be necessary. The following description of the machine itself is for background purposes only. Such devices are available in the marketplace and have been sold, distributed and in public use for many years.

The cold milling machine for which the present invention is adapted is illustrated generally at 10 in FIG. 1. The machine 10 has a body 12, hydraulically adjusted struts 14 on which are mounted wheels or tracks 16. The present invention will be described in conjunction with a machine 10 which is propelled by the movement of the tracks 16 although some variations of the device employ rubber tired wheels when the application so demands. The tracks 16 are hydraulically driven through any well known gearing system through a power train powered by a diesel engine 18. Steering linkage (not shown) connects the steering wheel 20 to the tracks 16 to guide the machine 10.

Mounted beneath the body 12 is a milling drum 22. The milling drum 22 is provided with teeth 24 positioned to form a helical cutter wound about the milling drum 22 (See FIG. 7). The milling drum 22 is contained within the drum housing generally referred to by reference numeral 26.

Considered in the orientation of the view shown in FIG. 1, the milling drum 22 rotates in a counter clockwise direction causing the teeth 24 to generate a succession of cuts in the pavement beneath the milling drum, each cut being slightly to the left of the preceding cut and eating into the face of an embankment into which the machine 10 is driven. The milling drum 22 can be driven in a clockwise direction to perform what is known as a "downcut" with the operation otherwise being as just described.

A structure commonly referred to as a moldboard is mounted on the underside of the body 12 of the machine 10 directly behind the milling drum. The moldboard is shown generally at 28 in FIG. 1–3. Moldboard 28 is positioned to track along, and in engagement or near engagement with, the cut surface immediately behind the milling drum 22. The moldboard 28 assists in containing cut material within a confined space so that the cut material will be swept toward the front of the device 10 and, because of the helical arrangement of the teeth 24, toward the left or inside of the machine. In a full width milling drum 22, the helically wound teeth are arranged such that the helical effect tends to move the waste material toward the center of the machine. Thus, waste material is moved from the outside of the machine toward the left and from the left (or inside of the machine) to the right or inside portion of the machine.

As the waste material is accumulated toward the center of the milling drum 22, the waste material is dumped into trough 30. Trough 30 may be equipped with any convenient conveyer type mechanism, generally a looped rotating conveyer belt with paddle wheels on it, to convey the material from its lower rear portion to its upper front portion and dump the material into the discharge conveyer 32. The discharge conveyer 32 is, once again, equipped with any convenient conveyer mechanism, generally a looped rotating conveyer belt with paddle wheels appended thereto, for advancing the waste material from its lower rear portion to its upper forward most portion. The conveyer 32 has an open end at its upper forward most portion 34 which dumps the waste material into a truck or other vehicle being driven directly in front of the machine 10. Once the truck is filled, the waste material may be carded from the cite and disposed of in a properly manner, and a second truck is placed below the conveyer 32 to allow the operation to continue.

Figure 2:
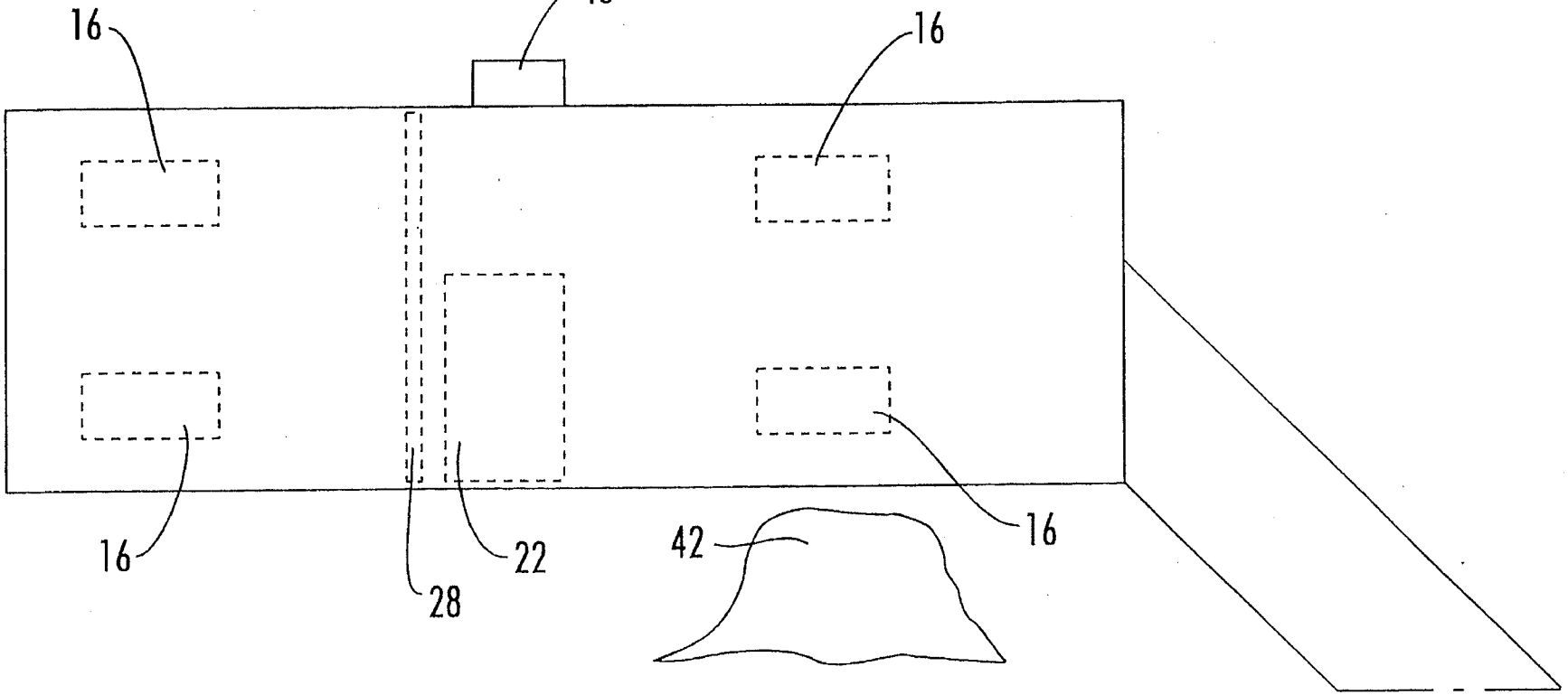
FIG. 2 is a plane view in schematic form of the device of the present invention showing a 3' cutter width.
Figure 3:
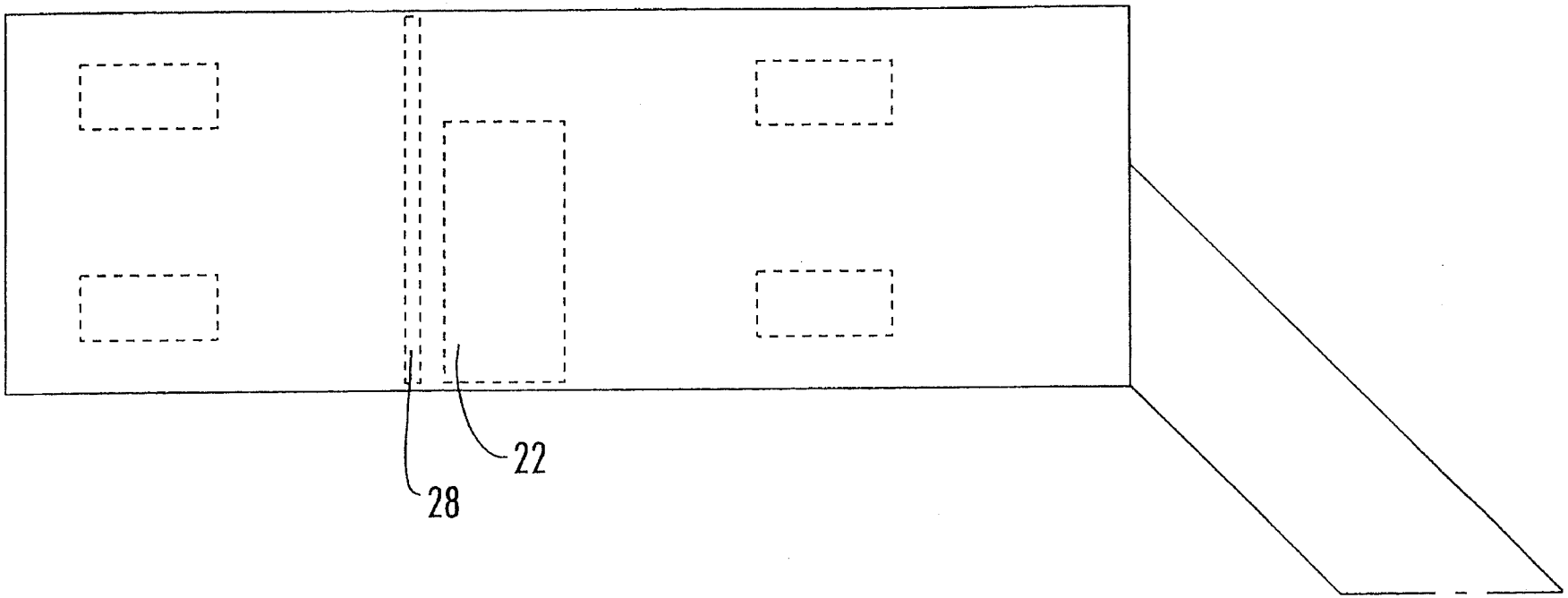
FIG. 3 is a plane view in schematic form of the improvement of the present invention showing the cutter in a 4' configuration.

FIG. 2 shows a schematic of a machine 10 equipped with a 3' milling drum 22 and FIG. 3 shows schematic of a machine 10 equipped with a 4' milling drum 22. Similarly, FIG. 4 shows a rear view of a machine equipped with a 4' milling drum and FIG. 5 shows a rear view of a machine equipped with a 6' milling drum 22. In FIGS. 4 and 5, the helical pattern of the teeth on the milling drum 22 can be readily seen.

The power to drive the milling drum 22 is transmitted from the diesel engine 18 through a clutch and power band to a reduction gear for maximum milling efficiency. Units of the type shown schematically in FIG. 1 will generally be provided with independent hydraulic systems for driving the conveyers, cooler fans, water sprinkler units and control functions. The hydrostatic pumps for the hydraulic systems are driven by the diesel engine via a splitter gear box. As the machine 10 moves in a forwardly direction (to the right in FIG. 1), the milling drum 22 is rotating in a counter clockwise direction, causing the teeth 22 to make the desired cut.

The power output of the diesel engine 18 is at a relatively high rpm. In order to convert the high rpm output to the power necessary to drive the milling drum 22 through dense rock, concrete, asphalt or other road surfaces, a gear reduction system is necessary. The power output of the diesel engine 18 includes a belt driven power train shown generally at 36 in FIG. 4. The power train 36 is housed within the housing 40 shown in FIG. 8 and because of design limitations, generally the housing 40 and drive train 36 protrude from the left side of the machine 10. If the drive train and its housing were on the right side of the machine 10, it would protrude beyond the outside cutting edge of the milling drum 22 and would prevent the machine from making flush cuts directly adjacent road barriers, bridge abutments and the like that would be to the fight of the machine. As can be seen from FIG. 2, such a barrier 42 will limit only modestly the extent of the reach of the milling drum 22. However, if the housing 40 were on the outside of the machine, the reach of the milling drum 22 would have to be substantially removed from the barrier 42.

Because of the size, power and design restrictions of machines such as this, based on the magnitude of the work performed and resistance to cuts of the milling drum 22 by virtue of the type of work being performed, the equipment is generally big, powerful, bulky and must be built within certain design limitations. It is not convenient to feed the power to the milling drum 22 from any place other than outside the body of the machine 10 without making the machine even larger. The power train cannot be connected to the milling machine inside the length of the milling machine without being overwhelmed by the debris and waste material created by the cutter. Further, in order to adequately transfer power to the milling drum 22, it is generally necessary to use a planetary gearing system which drives the milling drum from the inside. The features and limitations of such a system will be described in more detail in connection with the description of Applicant's improvement to the known structures. However, it is noteworthy to point out at this stage of the description of the machine to which Applicant's invention is directed that restrictions on design of the power train of such machines creates substantial barriers to the production of a machine that will achieve the desired results of Applicant's invention.

Heretofore are a number of problems that Applicant's invention addresses had to be solved by simply replacing one milling drum for another. For example, if a 6' cut were being made along a highway using a drum of the type as shown in FIG. 3, and the machine reached a point where the maximum cut permissible was 4', the 6' drum 22 of FIG. 3 would have to be replaced with a 4' drum 22 as shown in FIG. 2. The cost of having two drums on hand would be substantial and the man power and down time necessary to change the drums was significant and costly.

Applicant's invention has addressed and solved these problems by providing a milling drum, the cutting width of which can be readily and easily changed by one man using simple available hand tools in the course of a few hours. Applicant's invention will be described in conjunction with a combination cutter that can be modified from a 2' cut to a 3' cut to a 4' cut. While these combinations have been selected as optimal for the specific design of Applicant's invention, other designs would certainly be within the ambient of the present invention. It would simply be a matter of changing the size of the three or more stages of the cutter. The cutter could also be limited to only two stages if desired. However, for the purposes of describing the preferred embodiment of this invention, reference will be had to the optimal combination which includes a 2' cutter to the extreme fight of the machine, a 1' cutter that can be added directly adjacent the left side of the 2' cutter to make the cutting width 3', and a third cutter, 1' in length, that can be added to the combined first and second cutters to provide a cutter of 4' length. Likewise, the moldboards of Applicant's invention, as will be more particularly described hereinafter, are subject to adjustments with a first segment of the moldboard to the extreme fight of the machine being 2' in width, a second segment of the moldboard immediately to the left of the first segment of the moldboard 1' in width and a third segment of the moldboard immediately to the left of the second segment of the moldboard and being 1' in width. By structuring the moldboard in such a manner, the moldboard can be adjusted to mirror the width of the cutting drum.

Figure 9:
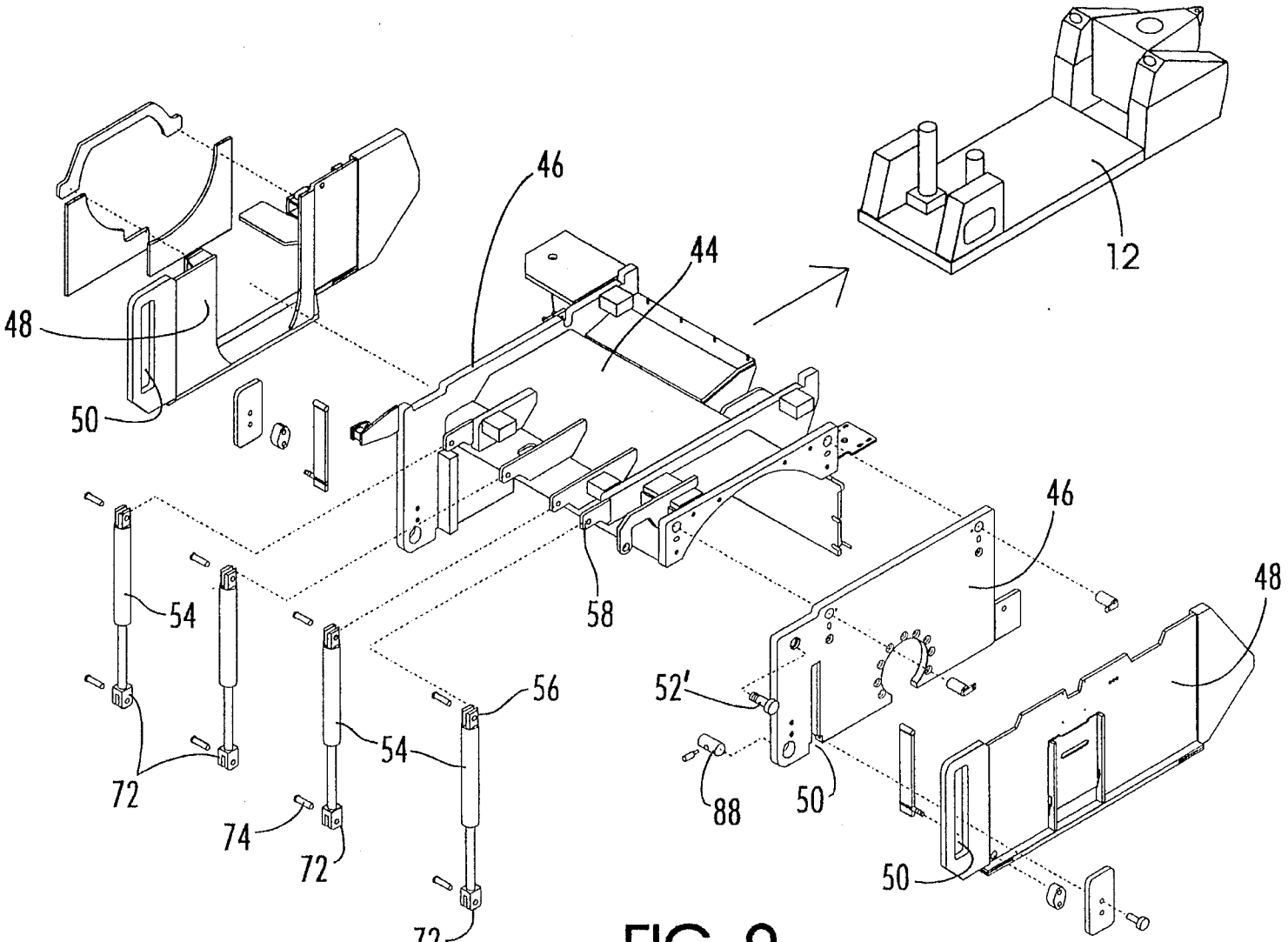
FIG. 9 shows a perspective view of the housing for the device of the present invention along with the hydraulically operated cylinder and piston lifter mechanism.
Figure 10:
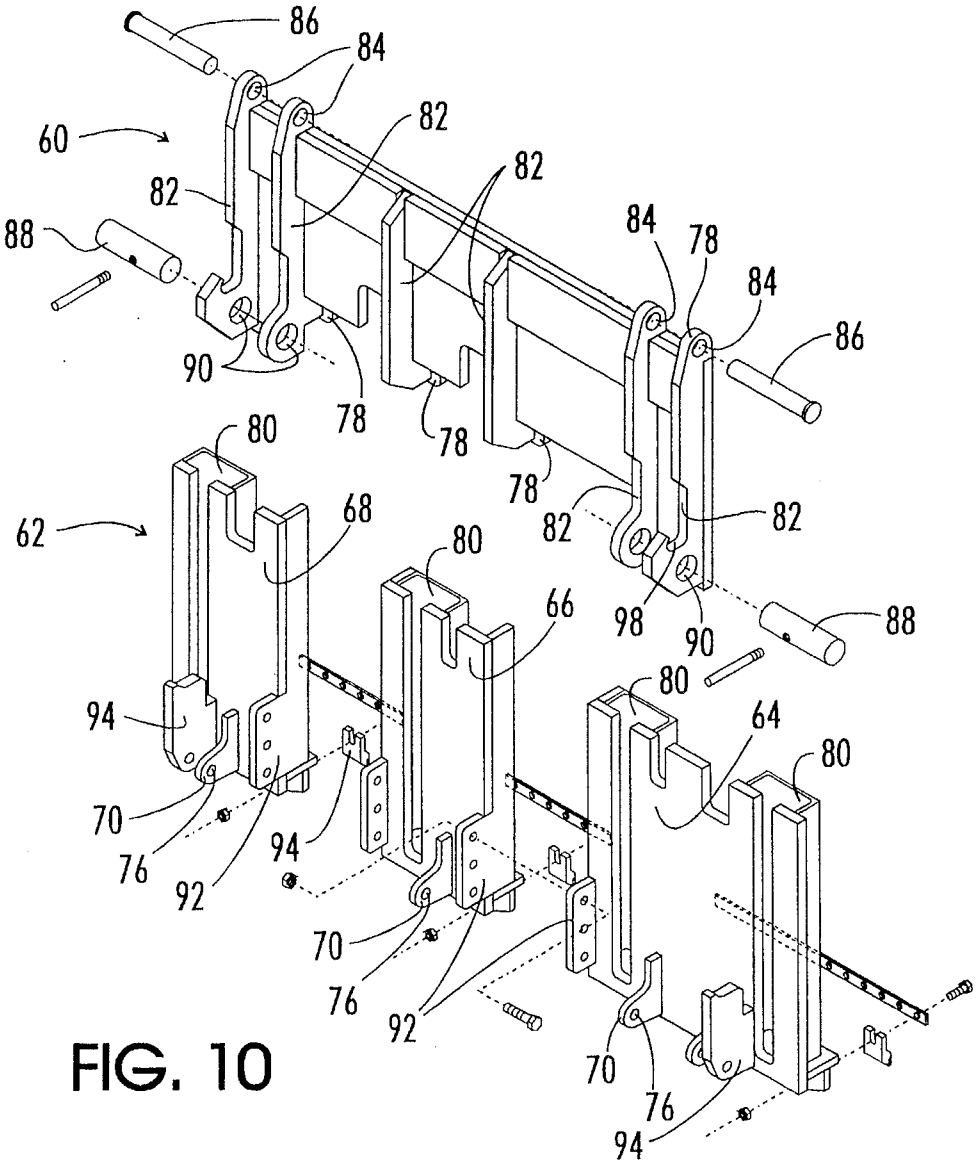
FIG. 10 shows the three-piece moldboard device in perspective view along with the lifter mechanism for the segment to the moldboard.

FIG. 9 illustrates the general housing of a cold milling machine 10. The body 12 overrides chamber 44 which encapsulates the top and front of the milling drum 22. Sideboards 46 and 46' are connected to the chamber 44 to enclose the milling drum 22 at the inside and outside respectively of the machine. Adjustable panels 48 are connected to the outside of sideboards 46, 46'. Adjustable panels 48 can be raised or lowered depending on the depth of cut of the milling drum. As can be seen from FIGS. 5 and 6, the struts 14 of the machine 10 are each adjustable in height so that the depth of cut by the milling drum 22 can be varied by adjusting the length of the struts 14 to which the tracks 16 are attached. The adjustable panels 48 and the sideboard 46, 46' have slots 50 through which a fastener mechanism 52 is bolted. The slotted arrangement allows the panels 48 to be adjusted in height to accommodate the depth of cut of the milling drum 22 and further provides for a slot into which a journal is inserted to fix the moldboard in relationship to the machine 10 in the operation mode.

Referring again to FIG. 9, lifters 54 are provided on the machine 10. The lifters 54 are preferably hydraulically driven piston/cylinder devices shown schematically in FIG. 15. The lifters 54 are pivotally attached at their upper end 56 to the chamber 44 and at their lower ends to the depending portion of moldboards 28. The pins at the upper portions 56 of the lifters 54 are connected through pin openings 58 in the chamber 44 such that the lifters 54 may be rotated about the point of connection between the pins and the pin openings 58.

The bottom end of the lifters 54 are connected to the moldboard 28. As can be seen from FIG. 10, the moldboard 28 is constructed of an upper portion 60 and a lower portion 62. The upper portion 60 of the moldboard 28 is of single piece construction whereas the lower portion 62 of moldboard 28 is constructed in sections. In the preferred embodiment, the three sections of the lower portion 62 of moldboard 28 are the 2' section 64, a first 1' section 66 and second 1' section 68. The upper portion 60 of moldboard 28 is overlapped by the lower portion 62 of the moldboard 28 so that the upper portion 60 lies between the sections 64, 66, and 68 and the milling drum 22.

The lifters 54 are on the outside of the lower portion 62 of the moldboard 28. Two facing gussets 70 extend rearwardly from the bottom of the section 64, and the sections 66, 68 each have one gusset 70 extending rearwardly therefrom. The lower most portion 72 of the lifters 54 are connected to the gusset 70 by pins 74. The pins 74 pass through holes 76 in the gussets forming a pivotal connection between the lower portion 72 of the lifter and the lower portion of the moldboard 28.

On the face of the upper portion 60 of the moldboard 28 facing the milling drum, there are four vertically aligned guide rails 78. The guide rails 78 are t-shaped in cross section, having a square head and an elongated neck spacing the square head from the face of the upper portion 60 of the moldboard 28. The guide rails 78 fit within the channels 80 of the lower portion 62 of the moldboard 28. The channels 80 have a cross sectional shape which mates with the cross sectional shape of the guide rails 78 so that the lower portion 62 of the moldboard can telescopically slide up and down in relationship to the upper portion 60 of the moldboard 28. Further, each section 64, 66, and 68 of the lower portion 62 of the moldboard 28 is free to move independently of the remaining sections of the lower portion 62 of the moldboard 28. The guide rails 78 fitting within the channels 80 keep the lower portion 62 of the moldboard 28 aligned with the upper portion 60 thereof while permitting the effective length of the sections 64, 66 and 68 of the moldboard 28 to be varied depending upon the particular job being performed.

The top of the upper portion 60 of moldboard 28 includes eye beam stabilizers 82 which add strength to the moldboard. The stabilizers also have ports 84 which enable the upper portion 60 of the moldboard 28 to be connected to the chamber 44 via journals 86 which pass through the ports 84 and through aligned journal ports (not shown) contained in the chamber 44.

The moldboard 28 can be fixed relative to the chamber 44 and the side boards 46, 46' via the solid tubes 88 passing through openings 90 in the eye beam stabilizers 82 and the opening 50 in the side boards 46, 46'.

In operation, when tubes 88 are placed in a position to lock the upper portion 60 of the moldboard 28 in a fixed relationship relative to the side boards 46, 46' and the chamber 44, the section 64, 66 and 68 of the lower portion 62 of the moldboard 28 are also locked in a fixed relationship relative to side boards 46, 46' and chamber 44 via the connection between sections 64, 66 and 68 with the guide rails 78 of the upper portion 60 fitting within the channels 80 of the sections of the lower portion 62. Absent further restraint, the sections 64, 66 and 68 would be allowed to float freely in an up and down motion relative to the upper portion 60 of the moldboard 28 but otherwise their movement is restrained.

When the machine 10 of Applicant's invention is configured for a 2' cut, section 64 is allowed to drop downwardly to a point so that the bottom of section 64 is substantially at the same level as the depth of cut created by the 2' cutter. The height of the section 64 is controlled by the hydraulic pressure placed on the two lifters 54 to the right side of the machine. In this configuration, the section 66 and 68 are bolted together by bolts passing through the openings in plates 92 thus, sections 66 and 68 respond as a unit and their height is controlled by the hydraulic pressure applied to the two lifters 54 to the left of the machine. If the machine is configured for a 3' cut, sections 64 and 66 will be bolted together at plats 92' and their height will be controlled by the hydraulic pressure applied to the three lifters 54 to the fight of the machine and the section 68 will float independently of the section 64, 66 and be controlled by the pressure applied to the hydraulic lifter 54 to the left of the machine.

When the machine is configured for a 4' cut, sections 64, 66 and 68 will all be bolted together by bolts connecting plates 92, 92' and the height of the moldboard will be controlled by the hydraulic pressure applied to the four lifters 54.

When it is necessary to work on the milling drum 22 to make the changes as will be hereinafter discussed to the milling drum, the hydraulic lifters 54 will be activated so that the sections 64, 66 and 68 are raised to a point where stops 94 engage the underside of the eye beam stabilizers 82. At that point, the upward movement of the sections 64, 66 and 68 relative to the upper portion 62 of the moldboard 28 is blocked and additional hydraulic pressure on the lifters 54 will cause the entire moldboard to rotate about the journals 86 in a clockwise direction as illustrated by the arrows 96 in FIG. 1, into a docking position. In the docking position, j-hook 98 (see FIG. 6) latches over protrusion 100 to hold the moldboard in the docked position. The moldboard will be held in the docked position by the j-hook 98 even though the hydraulic system is shut off so the machine 10 does not having to be running while the changes to the milling drum are being made.

Figure 11:
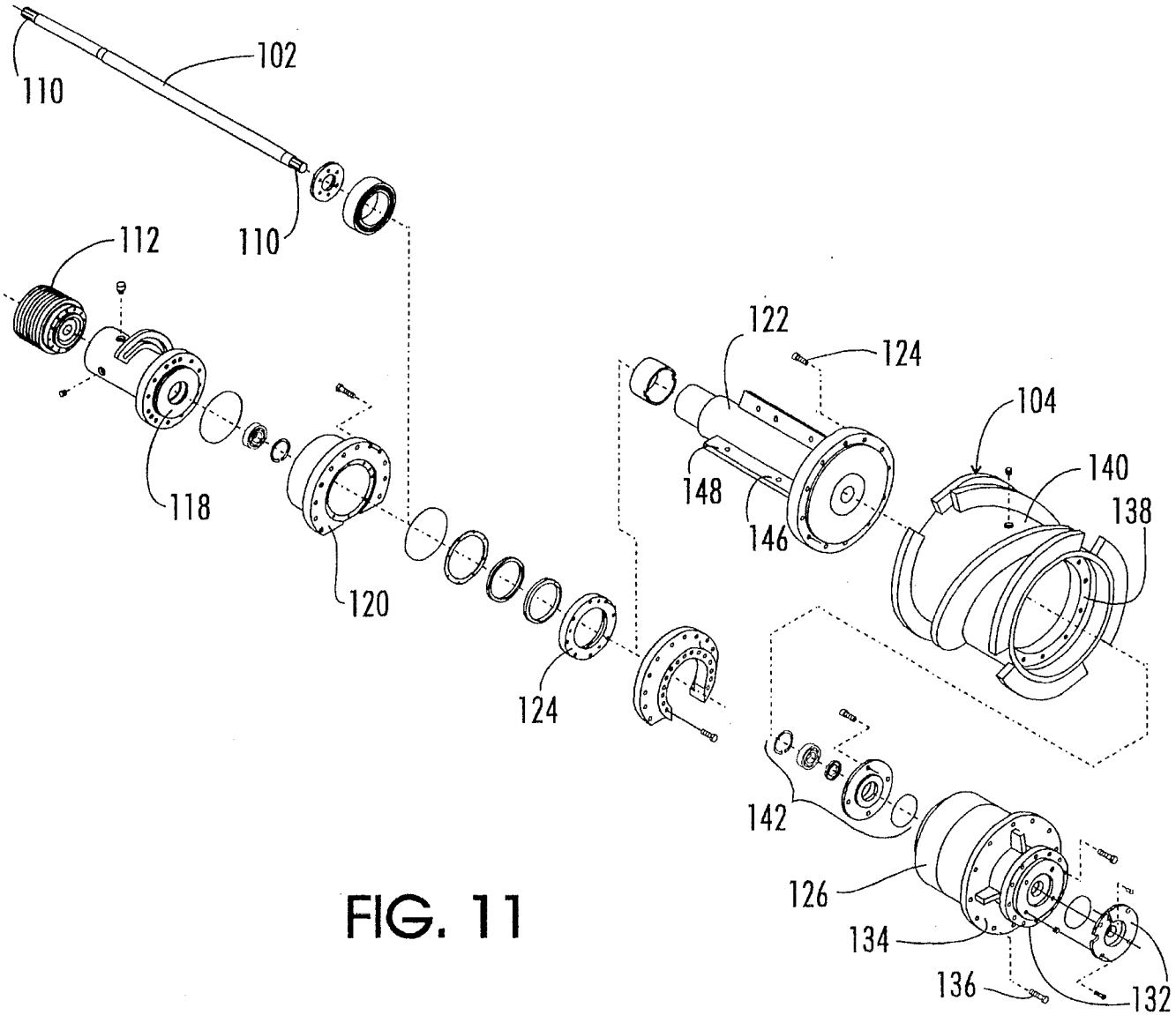
FIG. 11 shows a perspective view of the cutter device and its support structure.
Figure 13:
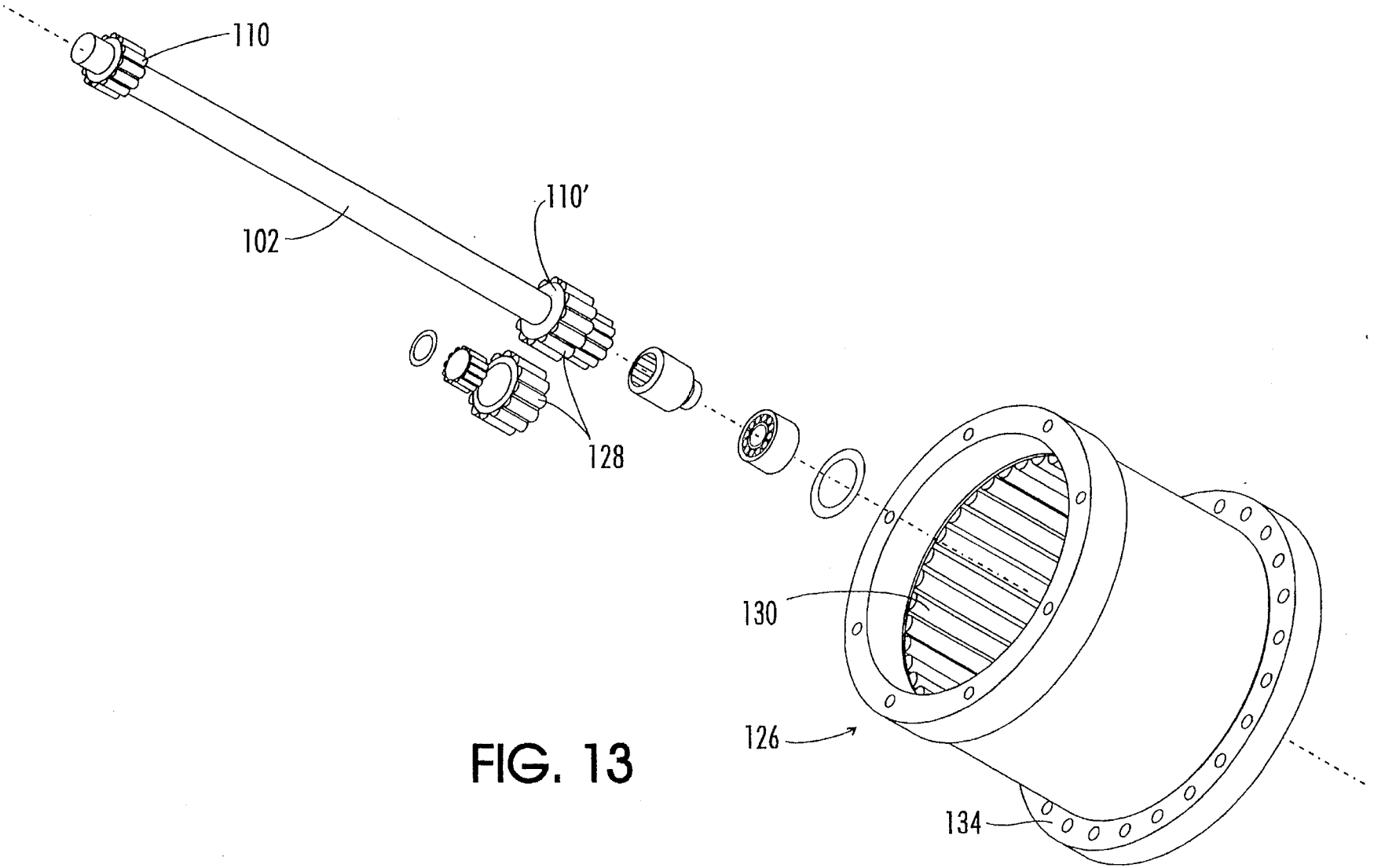
FIG. 13 shows a perspective view of a planetary gear of the type employed in the present invention.

Referring now to FIGS. 11, 13 and 14, the drive train for the milling drum will be described. Generally, the drive train consists of a drive shaft 102 lying substantially horizontally and extending from a point to the left of the machine beyond side board 46 and terminating at a point inside the milling drum 22. The milling drum 22 is divided into three sections, a 2' foot section 104 to the extreme right of the machine 10, a first 1' section 106 of the milling drum immediately to the left of section 104 and a second 1' section 108 immediately to the left of the first 1' section 106.

The drive shaft 102 has a spleen 110 at its left end (when viewing the machine 10 from the rear), and a second spleen 110' on its fight end. The spleen 110 engages a mating counterbore in pulley 112. Pulley 112 has a v-shaped profile 114 which engages the ribs of a belt connected to the drive output of the diesel engine 18. Thus, the ribbed belt (not shown) will rotate the pulley 112 which, because of the connection between the spleen 110 and the mating spleen of the pulley 112 will rotate the drive shaft 102. The drive shaft 102 is allowed to rotate by virtue of the bearing mount 116 fitted within flange 118 which is in turn connected to side board 46 via hub 120. Sleeve 122 is concentrically aligned with the drive shaft 102 and hub 120. Sleeve 122 is allowed to rotate relative to hub 120 by virtue of being mounted within hub 120 through bearing 124. Sleeve 122 is fixedly attached by bolt 124 to section 104 of milling drum 22 (see FIGS. 11 and 14).

The right end of the drive shaft 102 is connected to a planetary gear 126. A planetary gear of the type used in this application is generally illustrated in FIG. 13, although the specific planetary gear employed by Applicant is slightly modified as compared to the one illustrated in FIG. 13. However, the spleen 110' of the drive shaft 102 will be geared through gears such as gears 128 to engage with the gear teeth 130 formed on the inner wall of the planetary gear 126. Thus, the high rpm driving force channelled through the drive train just described will be geared down to the substantially reduced rpm of the rotating planetary gear 126.

The planetary gear 126 is mounted via beating assembly 132 to enable the planetary gear to rotate relative to the side board 46' in which the housing of the bearing assembly 132 is mounted. The face plate 134 of the planetary gear 126 rotates with the rotation of the planetary gear 126. The face plate 134 is bolted about its perimeter via bolts 136 through holes in the face 138 formed by counterboring the fight side of section 104 of milling drum 22. By bolting the face plate 134 to the drum portion 140 of section 104, rotation of drum portion 140 is driven via the power train just described. Oil sump 141 is formed by flange 118, hub 120, sleeve 122 and drum portion 140 and filled with oil to lubericate and cool the drive train and its rotating bearing assemblies.

Since planetary gear 126 is rotating at a substantially reduced speed relative to the rotation of the drive shaft 102, the connection and support between drive shaft 102 and the planetary gear 126 is via roller bearing structure 142. The reduced rpm rotation of the section 104 is transmitted to the sleeve 120 by virtue of the connection between the through bolts 124.

Figure 12:
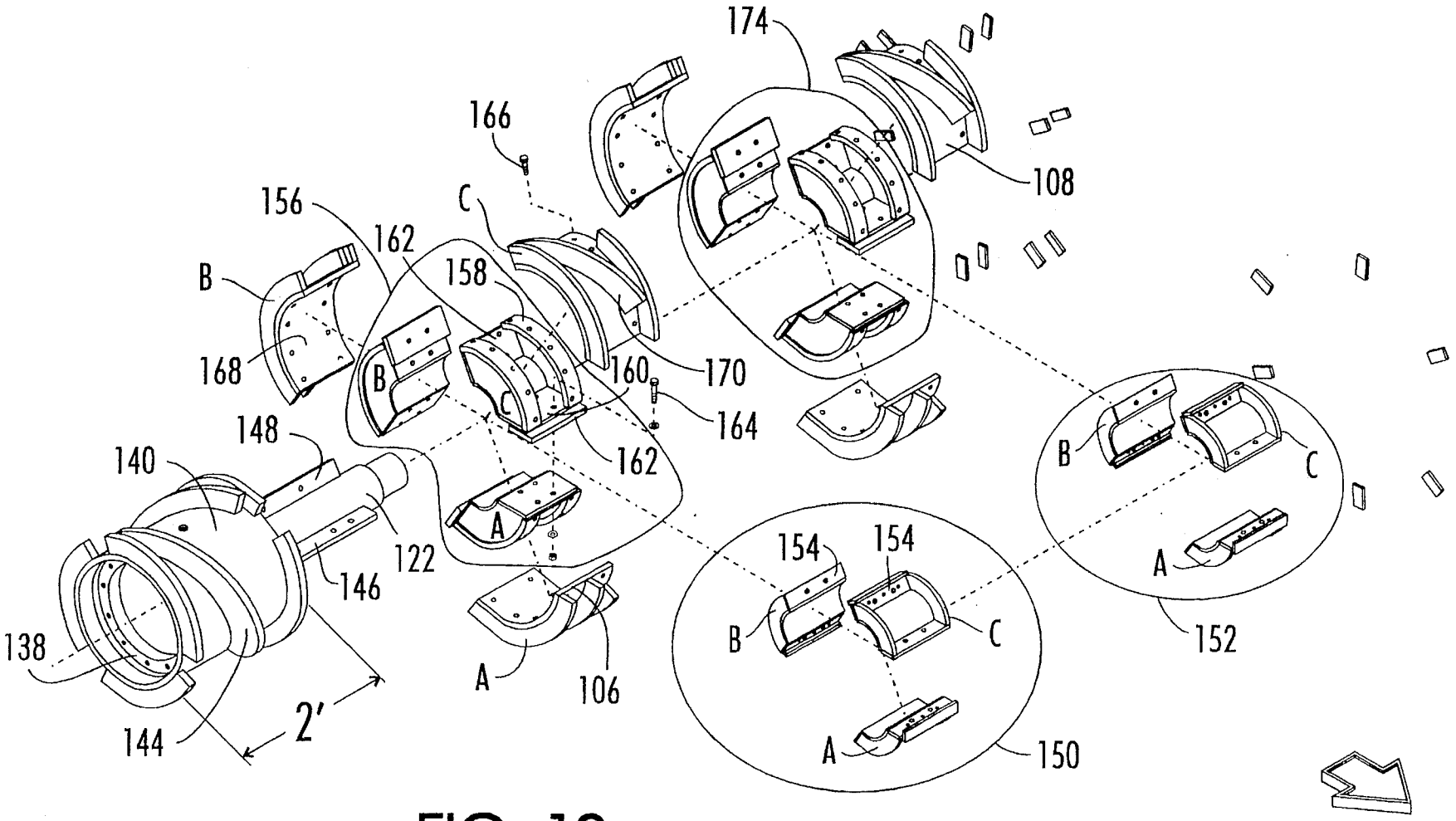
FIG. 12 shows a perspective view of the cutter drum and the add on segments to expand the width of the cutter drum.

Referring now to FIG. 12, the segmented structure of the milling drum 22 will be described. When the milling drum 22 is configured for a 2' cut, the 2' drum portion 140 will be the only cutting portion of the drum. Helical band 144 winds about the drum 140 and teeth (not shown) are bolted or otherwise affixed to the helical band 144 to perform the cutting function as previously described. The helical band 144 will also perform the function of delivering the waste material toward the center of the machine so that it can be dumped into the lower portion of the trough 30. When configured for a 2' wide cut, the milling drum 22 is to the outside or fight of the machine as viewed from the rear. The sleeve 122 has flanges 146 extending perpendicularly along the outer perimeter thereof parallel to the axis of the sleeve 122. In the preferred embodiment, there are three flanges 146 extending the length of the sleeve 122 from its point of connection to the drum 140 on the fight side to a point just inside the side board 46 of the machine 10 on the left side. The flanges 146 have holes 148 for the purposes hereinafter described. In the preferred embodiment of the invention, there are three flanges 146 and the paddle wheels (as hereinafter described) and the sections 106 and 108 are segmented each into three portions. However, the paddle wheels and the sections 106 and 108 could be divided into a different number of segments if desired. The preferred embodiment will be described in conjunction with a tripartite sectioning of the paddle wheels and the sections 106 and 108.

When the machine is configured for a 2' wide cut, a first paddle wheel 150 and a second wheel 152 are connected to the flanges 146, the first paddle wheel 150 being connected so that it will fit directly adjacent to the left edge of the drum 140 and the second paddle wheel 152 being connected so that it will be directly adjacent the left edge of the first paddle wheel 150. As can be seen from FIG. 12, the two paddle wheels 150 and 152 are segmented into sections a, b and c. The three sections a, b and c when bolted to the flanges 146 by bolts passing through holes 148 will form a circular paddle wheel about the sleeve 122 and will sweep the waste material thrown in their path by virtue of the helical configuration of the cutting teeth on band 144 into the lower portion of trough 30.

Each of paddle wheels 150, 152 are independently mounted on sleeve 122 and can be removed without disturbing the remainder of the assembly. When the machine is configured for a 2' cut, the paddle wheels 150, 152 will have their sweeping boards 154 aligned directly over the uncut surface of the road immediately to the left (when viewed from the rear of the machine) of the cutting section 104.

When it is desired to make a 3' cut, the first paddle wheel 150 is removed by loosening the bolts passing through holes 148 and removing those bolts so that the segments a, b and c can be removed without having to slide an integral paddle wheel off of one end or the other of the drive train.

Once the segments a, b and c of paddle wheel 150 have been removed, drum base 156 will be mounted in its stead. Drum base 156 includes segments a, b and c, each segment being substantially identical. The segments have an arcuate outer perimeter with radially extending holes 158 bored therein. Each segment a, b and c has a center arcuate channel 160 with face plates 162 on each end thereof. Bolts 164 pass through holes in the channel portion of the plates 162 and through the holes 148 in the flanges 146 of the sleeve 122 to connect the drum base segments a, b and c directly adjacent the left hand edge of section 104 of drum 140. After the drum base 156 is securely connected to the flanges 146 and thereby to the sleeve 122, drum section 106, which has been segmented into sections a, b and c are bolted to the drum base 156 by bolts 166 passing through holes 168 bored in a radial direction through the segments a, b and c of the section 106. The bolts 166 pass through the radially bored holes 168 and the radially bored holes 158 in the drum base 156 to connect to the segments a, b and c of section 106 of the milling drum 22 to the drum base 156. Segments of helical band 170 are provided on the perimeter of the segments a, b and c of section 106 with teeth bolted or otherwise attached thereto for performing the cutting function of the machine when configured with a 3' width. Likewise, the helical band 170 continues to direct waste material to the left of the machine so that the second paddle wheel 152 will sweep the waste material into the trough 30 for passage to a truck for ultimate disposal.

If a 4' cut is desired, the second paddle wheel 152 is removed in the same manner as paddle wheel 150 is removed from flanges 146 and the second drum base 174, which is divided into three sections a, b and c similar to the sections of the first drum base 156 are bolted to the flanges 146 directly adjacent to the section 106. Next, the three segments of section 108 are bolted to the drum base 174 to create a 4' wide cutter as desired. If sections 104, 106 and 108 are assembled in the machine, the moldboard will be connected to a 4' wide configuration and will lie directly behind the 4' wide milling drum. If the section 108 of the drum is removed, section 68 of the moldboard will be raised while section 64, 66 will be bolted together and lowered directly behind the 3' wide cutting width of the milling drum 22.

The moldboard can be held in the docking position previously described while the changes to the cutting width of the milling drum 22 are made. However, because the sections 106 and 108 of the milling drum are divided into segments a, b and c, they are of a weight and size that can be handled by one man, and the connection and disconnection of those segments can be performed with simple hand tools, all in approximately one hour.

Figure 15:
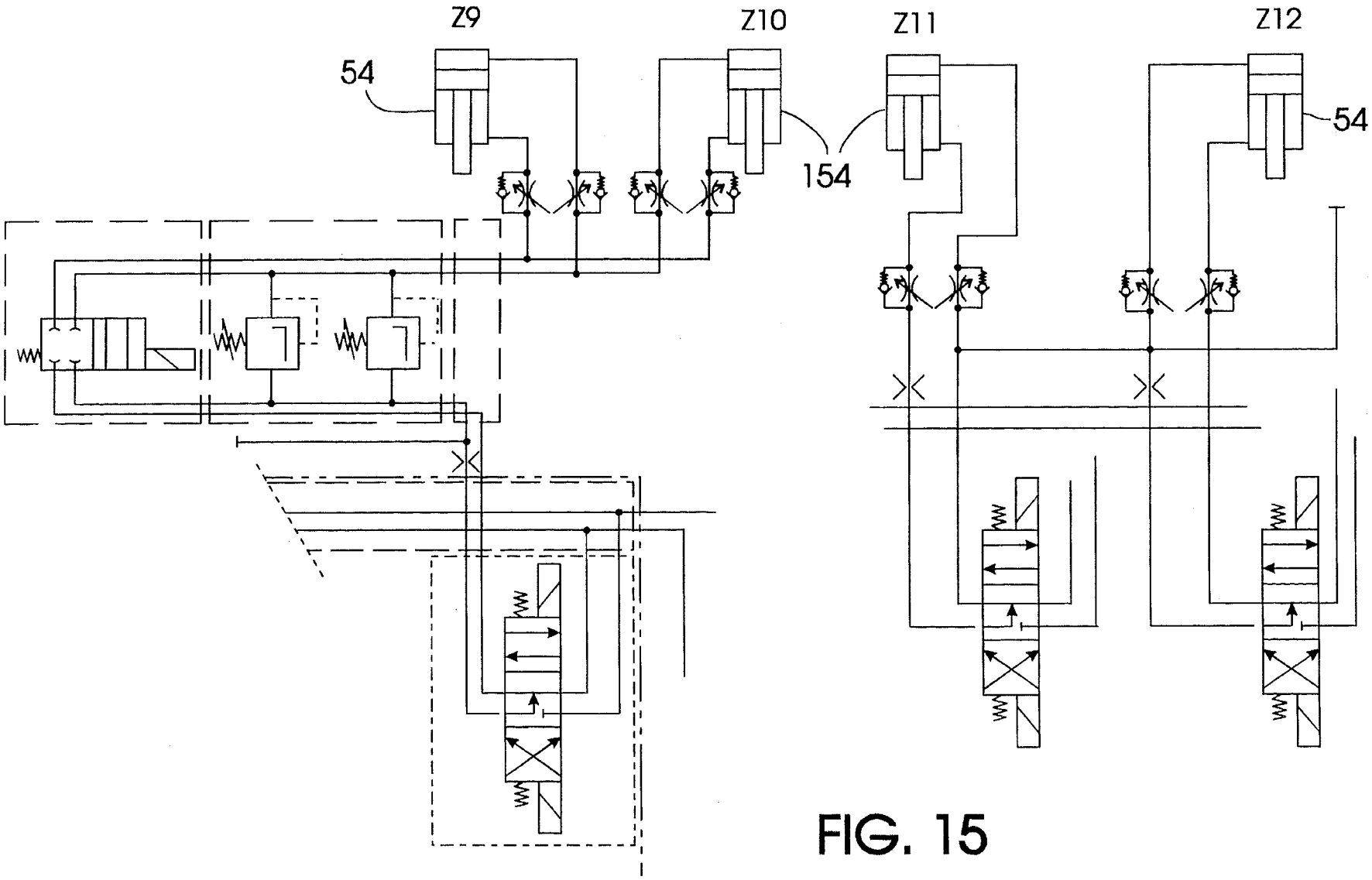
FIG. 15 shows a schematic view of the lifter mechanism and the switches necessary to activate the hydraulic lifting structure.

FIG. 15 illustrates generally the hydraulic structure for the lifters 54 and the electrical switching mechanism for operation of those lifters. The switching mechanism can be labeled for a 2' cutter, a 3' cutter or a 4' cutter, and when switches are aligned for a 2' cutter, sections 66 and 68 of the moldboard are connected and the two lifts 54 to the left of the machine (when viewed from the rear) are connected so that the hydraulic pressure on those two lifts are balanced and the pressure applied to the two lifts will cause the sections 66, 68 to raise to a point substantially parallel to the uncut road surface, depending upon the depth of cut being made by section 104 of milling drum 22 as determined by the length of extension of struts 14 on the left side of the machine 10.

When a 3' wide cut is being made, the switching mechanism is set for a 3' wide cut. The three lifts 54 to the right of the machine are then interconnected so their pressure will equalize and they will ride at the same level while the portion of the moldboard 68 will ride independently of the interconnected portions 64 and 66 all of which will be determined by the hydraulic pressure applied to the lifts 54 in direct conjunction with the depth of cut of the 3' wide milling drum as established by the degree of extension of the struts 14 to the left of the machine.

Finally, when a 4' wide cut is desired, all four lifts 54 are interconnected so that they each receive the same amount of hydraulic pressure and their height is adjusted to ride along the cut surface, the degree of extension of the moldboard being governed by the depth of cut as established by virtue of the degree of extension of the struts 154 of the machine.

Although there have been described particular embodiments of the present invention of a new and useful Milling Machine With Multi-Width Cutter, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

REFERENCES

Wirtgen America, Inc., Wirtgen 2000DC, 1900DC, 1500DC, 1300DC Cold Milling Machine, 1992, No. 24-10.10.0692.

What I claim is:

1. An improvement to a cold milling machine, such machines having means for advancing the machine along a given path and a milling drum mounted on the machine for cutting a width of material in the path of the machine and a conveyer mechanism for transporting waste material generated by the cut of the milling drum away from the machine, the improvement including:

a. a rotating milling drum divided into two or more sections with at least one of said sections being divided into segments;

b. means for removably mounting said segments to said milling drum whereby when said segments are mounted to said milling drum, the width of cut of the milling drum is increased, and when said segments are removed from said milling drum, the width of cut is decreased;

c. a drive train for providing power to rotate said milling drum;

d. said drive train having a power input end and a power output end; and e. the location of the segmented sections of the milling drum, when mounted to said milling drum, being between the power input end of said drive train and the the power output end of the drive train.

2. The invention as claimed in claim 1 wherein one section of said milling drum is of integral construction and is mounted on the output end of said drive train.

3. The invention as described in claim 1 wherein the machine includes a flush cut side and an opposing power input side and the improvement includes a planetary gear mounted on the flush cut side of the machine, milling means on the outside perimeter of said planetary gear, and a drive shaft passing from the power input side of the machine through the cutter drum and connected to said planetary gear.

4. The invention as described in claim 3 further including a sleeve surrounding at least a portion of said drive shaft and means allowing the drive shaft to rotate relative to the sleeve.

5. The invention as described in claim 4 wherein the portion of the drum adjacent the flush cut side of the machine is of integral construction and the sleeve is connected to said portion of the drum to cause the sleeve to rotate in fixed relationship to the rotation of the integrally constructed portion of said drum.

6. The invention as described in claim 5 wherein the sleeve, the drum and the planetary gear form a chamber, and oil is provided in said chamber to lubricate and cool the drive train.

7. The invention as described in claim 1 wherein said drive train includes a drive shaft and a sleeve surrounding at least a portion of said drive shaft and means allowing the drive shaft to rotate relative to the sleeve.

8. The invention as described in claim 7 wherein the sleeve has flanges extending radially therefrom and running along at least a portion of the length of the sleeve and wherein said segmented section of said milling drum are attached to said flanges.

9. The invention as described in claim 8 further including a segmented drum support which causes the diameter of the drum to equal the diameter of the integral portion of the drum and wherein the segmented sections of the drum support are attached to the flanges of the sleeve.

10. The invention as described in claim 1 wherein the width of the milling drum can be increased or decreased without the necessity of removing a section of the drum from over either end of the drive train.

11. The invention as described in claim 1 wherein the adjustments to the width of the drum are made in situ.

12. The invention as described in claim 1 wherein the segments of one section of the drum are pie-shaped in cross section.

13. The invention as described in claim 1 wherein the section(s) of the drum that is segmented includes segmented drum mounts which project radially from the drive train and a cutting element carrier mounted to each segment of the segmented drum mounts.

14. The device as described in claim 13 wherein the cutting element carder is arcuate and divided into multiple sections adapted to be bolted onto the segmented drum mounts.

15. An improvement to a cold milling machine, such machines having means for advancing the machine along a given path and a milling drum mounted on the machine for cutting a width of material the path of the machine and a conveyer mechanism for transporting waste material generated by the cut of the milling drum away from the machine, the improvement including:

a. a rotating milling drum divided into two or more second with at least one of said sections being divided into segments;

b. means for removably mounting said segments to said milling drum whereby when said segments are mounted to said milling drum, the width of cut of the milling drum is increased, and when said segments are removed from said milling drum, the width of cut is decreased;

c. a drive train for providing power to rotate said milling drum;

d. said drive train having a power input end and a power output end;

e. the location of the segmented sections of the milling drum, when mounted to said milling drum, being between the power input end of said drive train and the remaining section(s) of the milling drum; and f. a segmented paddle wheel adapted to be bolted to said drive train to replace each segmented section of the cutting drum that is removed from the drum to decrease the width of the cut of the machine.

16. The device as described in claim 15 wherein the segmented portions of said paddle wheel are arcuate in shape.

17. An improvement to a cold milling machine, such machines having means for advancing the machine along a given path and a milling drum mounted on the machine for cutting a width of material in the path of the machine and a conveyer mechanism for transporting waste material generated by the cut of the milling drum away from the machine, the improvement including:

a. a rotating milling drum divided into two ore more sections with a at least one of said sections being divided into segments;

b. means for removably mounting said segments to said milling drum whereby when said segments are mounted to said milling drum, the width of cut of the milling drum is increased, and when said segments are removed from said milling drum, the width of cut is decreased;

c. a drive train for providing power to rotate said milling drum;

d. said drive train having a power input end and a power output end;

e. the location of the segmented sections of the milling drum, when mounted to said milling drum, being between the power input end of said drive train and the remaining section(s) of the milling drum; and f. a moldboard divided into sections with the number and width of the sections of the moldboard corresponding to the number and width of the sections of the milling drum.

18. The invention as described in claim 17 further providing means for interconnecting the moldboard sections.

19. The invention as described in claim 18 wherein said moldboard includes an elongated upper portion and the sections of said moldboard are mounted on said elongated upper portion of the moldboard.

20. The invention as described in claim 19 wherein the sections of the moldboard are connected to the elongated upper portion of the mole board by rail and channel means which allows the lower portion of the moldboard to move up and down relative to the elongated upper portion of the moldboard when the moldboard is fixed in an operating position directly behind the milling drum.

21. The invention as described in claim 20 further including means for mechanically lifting the sections of the moldboard and for regulating their height.

22. The invention as described in claim 21 wherein the means for mechanically regulating the height of the moldboards include hydraulic lifters.

23. The invention as described in claim 21 wherein the means for lifting the moldboards also move the moldboard to a docking position to permit access to the milling drum.

24. An improved milling drum for mounting on a vehicular milling machine, said improved milling drum including a drive train extending across the width of the vehicular milling machine, said drive train having an input end on one side of the vehicular milling machine and an opposing output end, a first section of the milling drum connected to the output end of the drive train and mounted substantially flush with the side of the machine opposite the input end of the drive train, one or more segmented sections of the milling drum means for attaching the segments of said one or more segmented sections to said first section whereby said one or more segmented sections are located between said first section and the input end of the drive train of the machine.

25. The invention as described in claim 24 wherein said first section of said milling drum and said drive train each having an outer perimeter that is substantially cylindrical in cross section and the diameter of outer perimeter of the drive train is substantially less than the diameter of the outer perimeter of said first section of said milling drum.

26. The invention as described in claim 25 including a segmented radial adaptor adapted to attach to the outer perimeter of the drive train to increase the diameter of the said one or more additional segmented sections of the milling drum to substantially the diameter of the said first section of the milling drum and segmented cutting elements mounted on said segmented radial adapters.

27. The invention as described in claim 26 including means for selectively connecting said segmented radial adapter to said drive train and removing said segmented radial adapters from said drive train, and further including a segmented paddle wheel for mounting on the drive train when said one or more additional segmented sections of the drum are removed therefrom to provide a reduced diameter paddle wheel for sweeping waste material generated by the cutting element into a waste removal system.

28. A mobile milling machine including means for propelling the machine over a surface along a desired path and an engine to provide power for propelling said machine, a milling drum rotatably mounted on the machine, said milling drum being cylindrical in cross-section and having an axis and an outer perimeter, cutting elements on the outer perimeter of the milling drum for cutting the surface, a moldboard mounted on the machine adjacent said milling drum, the axis of said milling drum aligned substantially parallel to said surface, said machine having a power input side and a flush cut side, the axis of the milling drum extending between said sides, means for providing rotating power to said milling drum at said power input side, means for transferring said power from said power input side to said flush cut side, means for causing said power at said flush cut side of said machine to rotate said milling drum directly adjacent said flush cut side of said machine, said milling drum divided into two or more sections, each section having ends along the length of the milling dram lying in a plane substantially perpendicular to the axis of the said milling drum, at least one of said sections of said milling dram remote from said flush cut side of said machine, and said moldboard being divided into one or more sections.

29. The invention as described in claim 28 wherein said at least one of said sections is constructed in segments with each segment adapted to be connected to and removed from said milling drum to increase and decrease the size of the cut of the surface.

30. The invention as described in claim 29 wherein said segments are substantially wedge shaped and further including a carrier on which are mounted cutting elements, said carrier adapted to be selectively mounted on and removed from said segments.

31. The invention as described in claim 25 wherein the diameter of the outer perimeter of the drive train is approximately 16" less than the diameter of the outer perimeter of the milling drum.

* * * * *